US006161846A

United States Patent [19]

Soderberg

[11] Patent Number: 6,161,846

[45] Date of Patent: Dec. 19, 2000

[54] SKATE

[76] Inventor: Mark S. Soderberg, 1364 Placid Dr., Evergreen, Colo. 80439

[21] Appl. No.: 09/302,166

[22] Filed: Apr. 29, 1999

Related U.S. Application Data

[60] Provisional application No. 60/083,394, Apr. 29, 1998.

[51] Int. Cl.[7] ..... A63C 17/06

[52] U.S. Cl. ..... 280/11.225; 280/11.231; 280/11.233; 280/11.28

[58] Field of Search ..... 280/842, 11.221, 280/11.224, 11.225, 11.231, 11.233, 11.27, 11.28, 11.223

[56] References Cited

U.S. PATENT DOCUMENTS

| | | | |
|---|---|---|---|
| 893,341 | 7/1908 | Martinsen | 280/11.233 |
| 1,703,936 | 3/1929 | Jervoise | 280/11.233 |
| 1,866,134 | 7/1932 | Smith | 280/11.225 |
| 2,719,724 | 10/1955 | Lundgren | 280/11.233 |
| 3,339,936 | 9/1967 | Hamlin . | |
| 3,653,678 | 4/1972 | Collett | 280/11.225 |
| 4,838,564 | 6/1989 | Jarvis | 280/11.233 |
| 5,303,940 | 4/1994 | Brandner . | |
| 5,405,156 | 4/1995 | Gonella . | |
| 5,549,309 | 8/1996 | Gleichmann . | |
| 5,566,957 | 10/1996 | Ho . | |
| 5,603,519 | 2/1997 | Conte . | |
| 5,704,620 | 1/1998 | Oliemans et al. . | |

FOREIGN PATENT DOCUMENTS

| | | |
|---|---|---|
| 2204834 | 11/1997 | Canada . |

*Primary Examiner*—Michael Mar
*Attorney, Agent, or Firm*—Dellett and Walters

[57] ABSTRACT

An in-line skate enables the wheels to follow an arc when turning, thereby offering such enhanced performance characteristics as energy return, shock absorption and reduced turning diameters. The skate comprises a flexible beam affixed to a rigid boot backbone by a single attachment position bracket. The flexible beam carries the skate wheels thereon, and is adapted to flex about its single attachment location in response to the radial force generated while turning, aligning the wheels of the skate toward the radius of the turn, making the turn easier and more energy efficient. Additionally, flexing of the beam under the load of the skater in usage will result in a spring back of the beam when the load is reduced, providing an energy return system to recover energy that would otherwise be lost during certain skating maneuvers.

7 Claims, 4 Drawing Sheets

SKATE

This appln claims the benefit of U.S. Provisional No. 60/083,394 filed Apr. 29, 1998

BACKGROUND OF THE INVENTION

This invention relates to skates, and more particularly to an in-line skate with enhanced turning characteristics.

The in-line skate industry is relatively new and numerous skate configurations and designs abound. As this sporting field evolves, so does the ability of the skaters, necessitating a higher degree of sophistication in the equipment. Areas of concern of skaters relate to, for example, the ability to turn more easily, more smoothly, faster, and with less physical stress on the skater.

As with most sporting equipment, there is also a problem of wear and tear on the equipment relating to in-line skates. In-line skates especially experience wear in the wheels, due to the nature of the surfaces on which the skates are typically used. Because wheel-to-pavement friction both increases wheel wear and energy losses, reducing this friction would result in longer equipment life as well as increased speed. Traditional in-line skates have fixed orientation wheels, typically aligned with a straight ahead direction of travel and mounted to rigid frames, which makes turning with the skates less efficient, since the wheels are held straight ahead while the skater attempts to turn. Further, the wheels of many skates are fixed in a line but the middle wheels may be slightly lowered to give the effect of "camber" corresponding to the arc ground into an ice skate blade, to make the wheels contact the ground when turning. However, the middle wheels really don't stay lowered very long because the wheels quickly wear down to be even with the outer wheels. Most skaters are not even aware that their skates have this cambered configuration.

As with competitive speed sports, the loss of any energy to the equipment is a source of inefficiency, leading to a loss of speed. Any method of energy return from the skates would render a competitive edge to the skater.

Another consideration of avid users is their long term physical damage as well as the uncomfortable sensations due to shock transmitted to the skaters when "striding". The area of shock absorption is thus another major concern to in-line skate aficionados.

Therefore, conventional skates lack enhanced features to enable efficient turning as well as to increase the "user friendliness" of operation for improved enjoyment by in-line skaters.

SUMMARY OF THE INVENTION

In accordance with the invention, an in-line skate is provided with a beam extending along the longitudinal length of the skate and mounting the wheels thereon. The beam is attached to the skate body at a single position, preferably near the center of the skate. The beam is sufficiently rigid to support the skater, but will flex from side to side during turns to provide smoother turning, as the wheels are thereby more aligned with the radius of the turn.

Accordingly, it is an object of the present invention to provide an improved in-line skate that allows the wheels to somewhat follow the arc of a turn when the skate is turning.

It is another object of the present invention to provide an improved in-line skate that incorporates a beam that flexes to place the wheels in an arc when turning to enhance maneuverability.

It is a further object of the present invention to provide an improved in-line skate that incorporates a beam that flexes to place the wheels in an arc when turning to reduce wheel-to-pavement friction, reducing wheel wear and reducing energy losses.

It is yet another object of the present invention to provide an improved in-line skate that incorporates a beam that flexes to reduce the shock transmitted to the skaters when "striding" and to also provide an energy return system where the beam flex "spring back" returns energy lost when the beam flexes as the rider's foot strides on the pavement.

It is a further object of the present invention to provide an improved in-line skate that enables use of a beam of varying dimensions that can be customized to accommodate the rider's needs with respect to speed or maneuverability.

It is a further object of the present invention to provide an improved in-line skate with enhanced features to increase "user friendliness" operation for the improved enjoyment of in-line skating.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
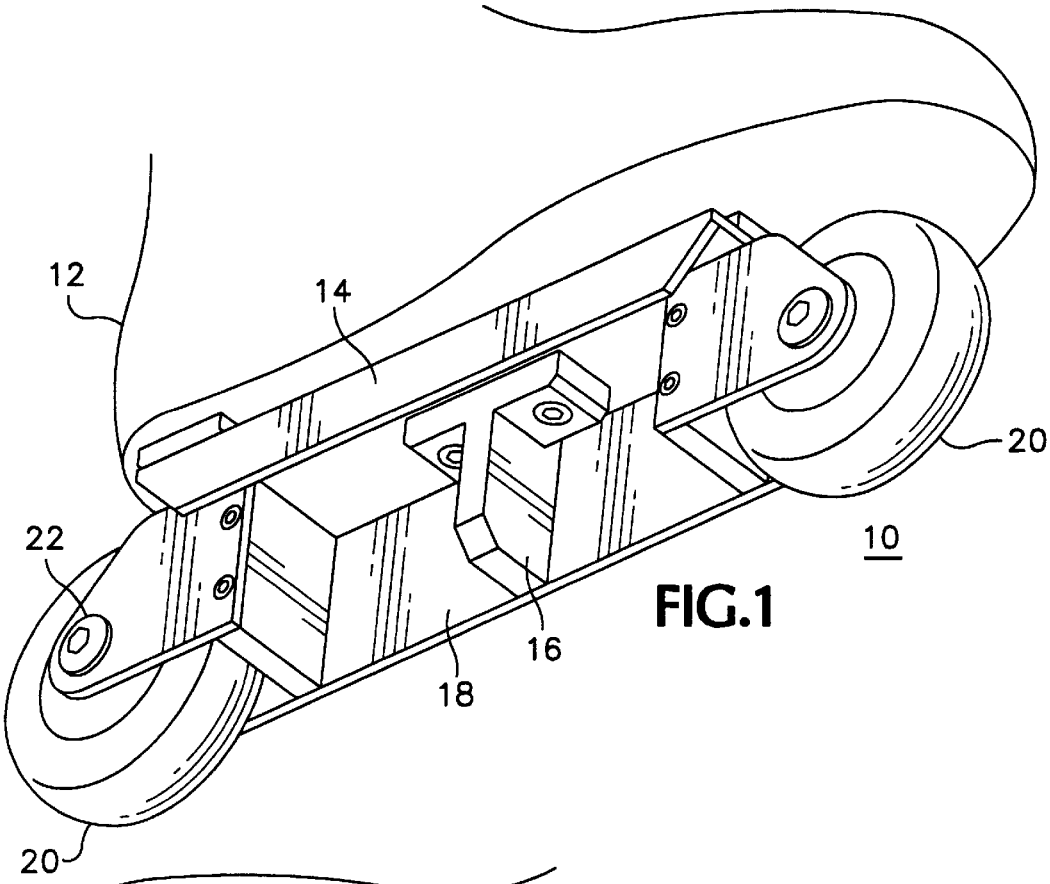
FIG. 1 is a lower side perspective view of a skate according to the invention, taken from the medial side.
Figure 2:
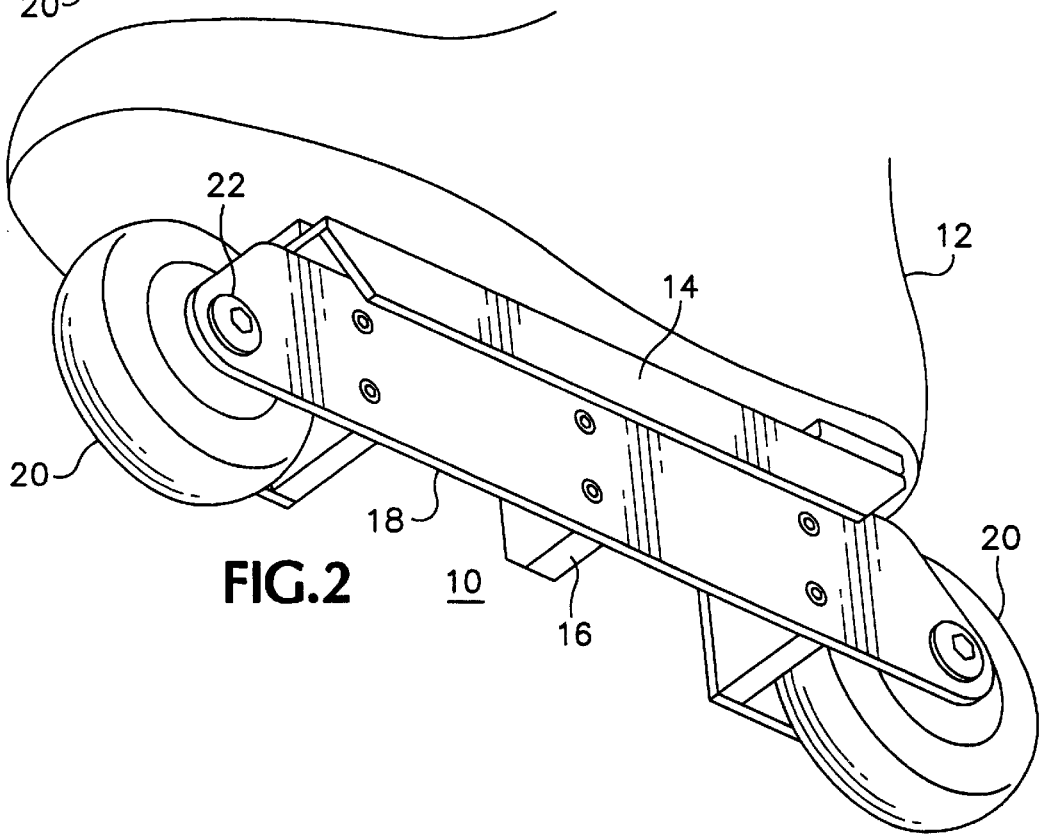
FIG. 2 is a lower side perspective view of a skate according to the invention, taken from the lateral side.

Referring to FIG. 1 and FIG. 2, lower side perspective views of a skate according to the invention, taken from the medial side and the lateral side respectively, the in-line skate 10 comprises a skate boot 12 mounted on a rigid backbone frame 14, which is mounted to the sole of the boot and extends along a substantial portion thereof. Approximately centrally of the boot, mounted to the frame 14 is a bracket 16 providing for a single position attachment to an elongate beam 18 which carries the front and rear wheels 20. The bracket is suitably secured to the frame 14 via bolts or the like, to allow removal for repair or replacement. The wheels are mounted via axles 22, which are also adapted for removal, to enable replacement of worn wheels.

Figure 3:
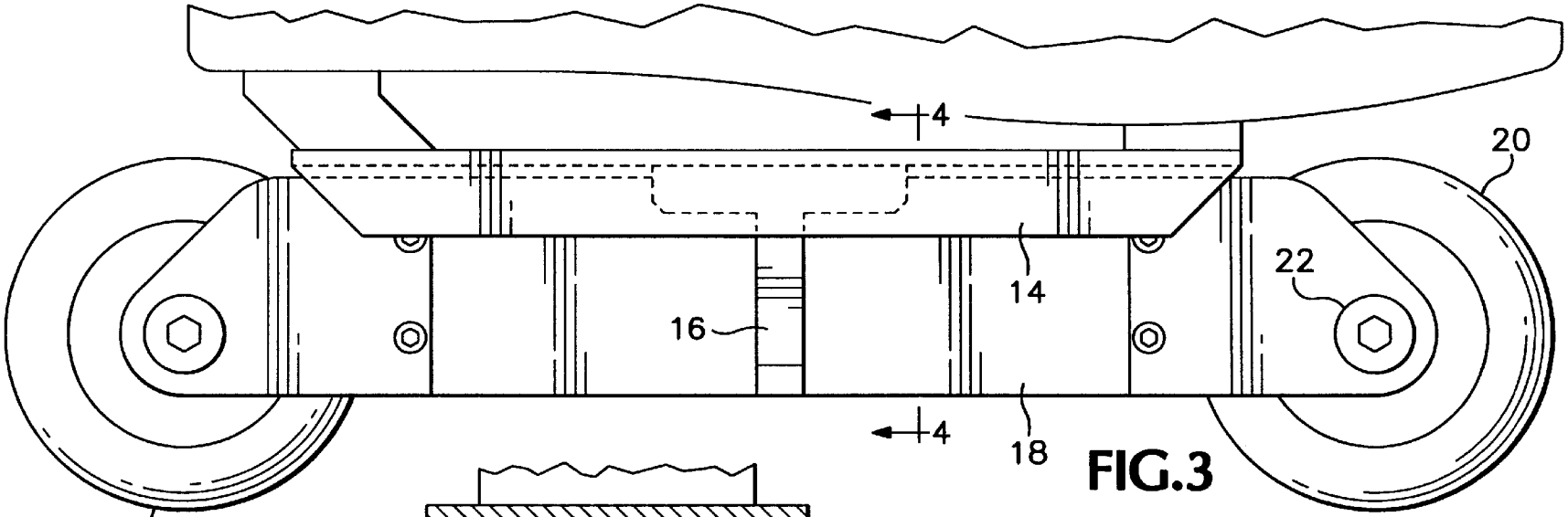
FIG. 3 is a partial side view of the skate.
Figure 4:
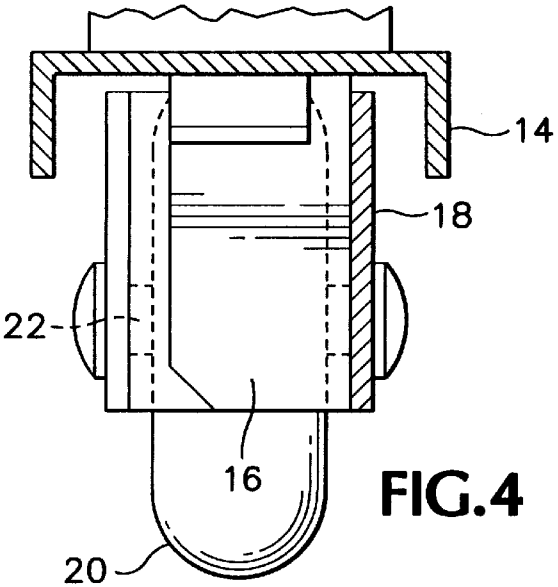
FIG. 4 is a sectional view taken along line 4—4 of FIG. 3.

FIG. 3 is a partial side view of the skate with the boot upper cut away and FIG. 4 is a sectional view taken along line 4—4 of FIG. 3. In the illustrated embodiment, frame 14 is a channel member constructed of aluminum. Other configurations and materials are also suitably employed.

Figure 5:
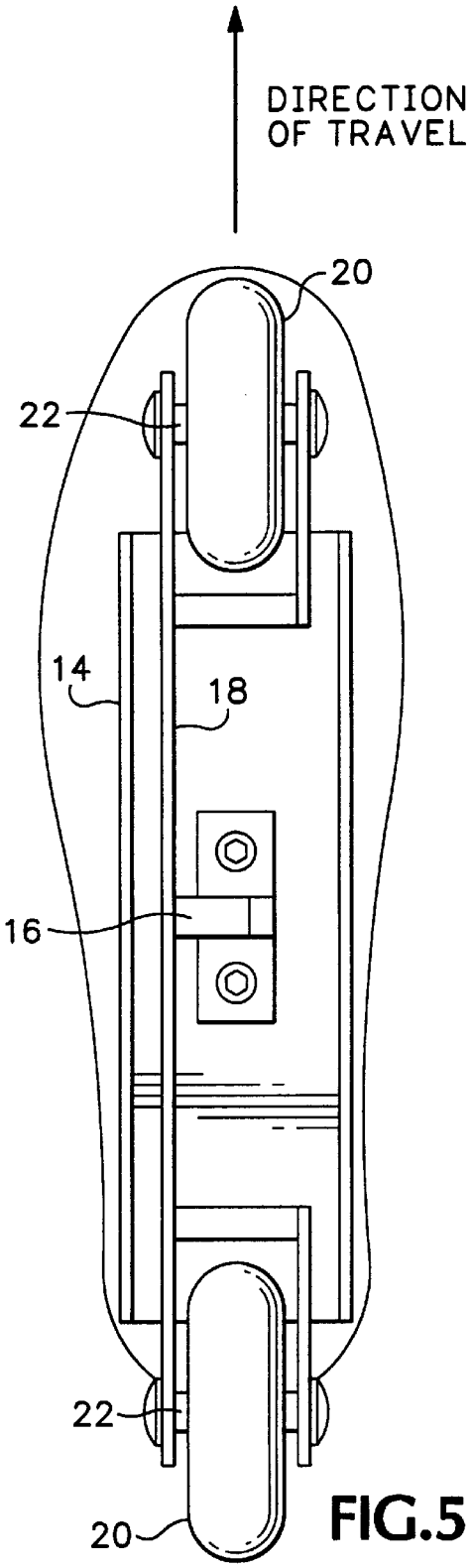
FIG. 5 is an underneath view of the skate illustrating the configuration of the skate when traveling in a straight direction.
Figure 6:
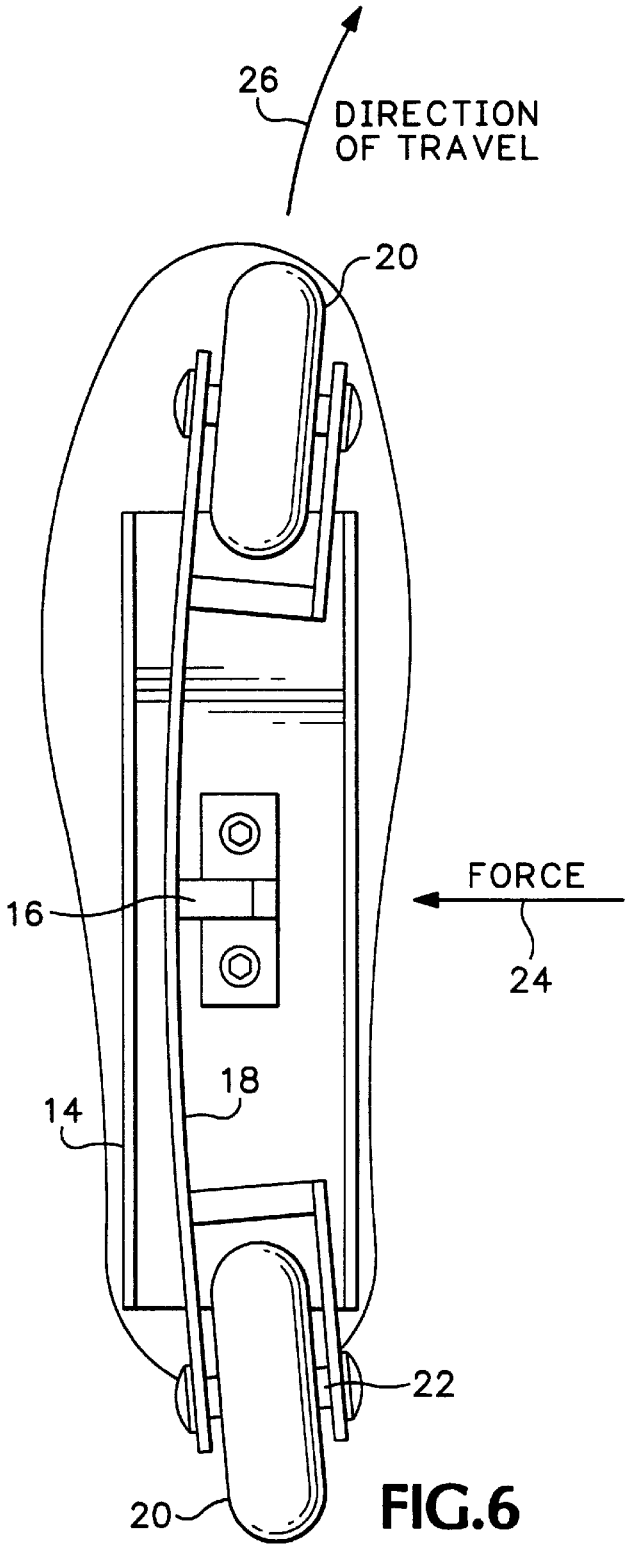
FIG. 6 is an underneath view of the skate illustrating the configuration of the skate when turning.

In use, the backbone frame 14 provides a support structure that attaches to the boot upper and minimizes flexing of the unit under the weight of the skater, while the bracket 16 serves as the single point or position about which the beam 18 is able to flex while the user is skating. This single position attachment is a factor that allows the beam to flex and align the wheels to facilitate efficient turning, providing function and advantages to the in-line skate. Accordingly, referring to FIG. 5 and FIG. 6, which are underneath views of the skate according to the present invention, illustrating the configuration of the skate when traveling in a straight direction and when turning, respectively, typically the radial force encountered when making a turn is perpendicular to the axis of the skate. In FIG. 6, the force illustrated by reference number 24, results when making a turn in the medial direction (illustrated by arc 26). This radial force causes the beam 18 to flex or to bend somewhat, suitably aligning the wheels in an arc that corresponds to the radius of the turn being negotiated and illustrated by arc 26 (similar to the bending of a ski to form an arc when turning). The radial load developed when turning is transmitted, via the bracket 16, to one side of the proximate center of the beam 18. The friction of the wheels against the ground exerts a directionally opposing force on the opposite side of the beam, near the beam's ends. This results in a flexing of the beam that aligns the wheels towards the radius of the turn. Any flexing of the beam under the load of the skater during use will result in a spring back of the beam when the load is removed. This feature of the flexible in-line skate serves as an energy return system to allow the recovery of energy that would normally be lost when striding or turning. Typically in a vertical plane, the beam is substantially rigid and flexes very little, if at all.

Thus, the in-line skate wheels trace an arc in the direction of travel, reducing the friction between the wheels and the pavement, increasing wheel life, decreasing the energy lost in turning, and facilitating ease of maneuverability. Since a skater's stride is not completely linear, but rather has a slight arcing motion, the in-line skate reduces the shock transmitted to the users legs and feet. This is an improvement over conventional in-line skating technology, wherein the skate wheels trace a line tangential to the direction of travel, when negotiating a turn. Striding generates a lateral load that bends the beam in the arc, and this lateral flexing provides a springy feel, energy absorption and return.

It will be noted that the performance of the in-line skate with regard to turning or speed, varies with the length and thickness of the beam. Therefore, different beam dimensions are employed to provide skates with different performance characteristics. For example, a skate with a longer beam will allow a greater range of flexing at the distal ends of the beam, making a skate that is more inclined to turn. Thicker or thinner beams will exhibit different flexing characteristics. Accordingly, the beam dimensions can be altered to provide skates with various performance characteristics. Since the beam is removably mounted to the skate, plural beams can be kept at hand of different flexing properties and lengths, for quick change by the user if desired.

Figure 7:
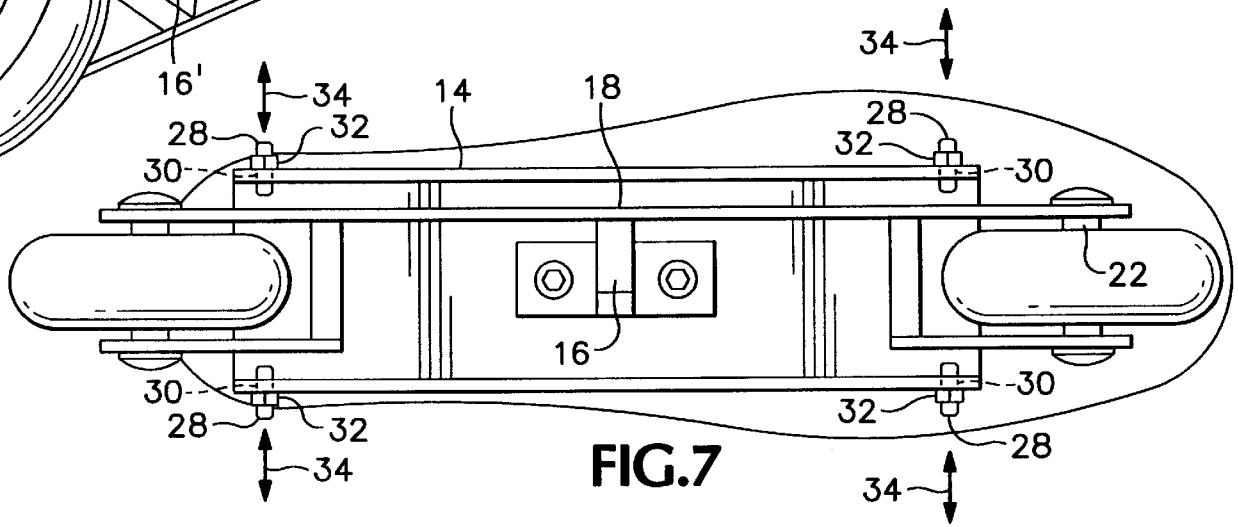
FIG. 7 is an underneath view of an alternative skate illustrating adjustable flexing control.

Also, in an alternative embodiment, as illustrated in FIG. 7, which is an underneath view of an alternative skate, the amount of lateral flexing allowed in the beam is adjustable. In this embodiment, a number of set screws 28 are provided, spaced a distance away from and on either side of the bracket 16, at front and rear positions of the frame 14. In the illustrated embodiment, four such set screws are provided, two adjacent the front wheel area and two adjacent the rear wheel area, at medial and lateral sides of the frame. The set screws are received through threaded holes 30 in the frame (illustrated in phantom) and a lock nut 32 is provided on the outer sides of the frame, whereupon the screws 28 are adjustable inwardly or outwardly along the axis denoted by arrow 34 to move the end of the set screws closer to or farther from beam 18 or the frame surrounding the wheel on the side of the wheel opposite the beam. As the screws are moved in or out, the degree of flexing allowed before the beam is changed by the stopping of further flexing by contact of the beam (or the wheel frame) with the interior end of the respective set screw. Therefore, by adjusting the position of the screws 28, the maximum amount of flexing that the beam is able to make can be defined, the set screws fix the limits of stop points beyond which the beam is not allowed to flex. Accordingly, a more or less flexible skate response is provided. Providing set screws on either side of the beam enables adjustment of flexing in both lateral directions. Lock nuts 34 serve to secure the set screws from unintended movement once the screws have been adjusted to a desired position.

In the preferred embodiment, the backbone frame is fairly rigid with regard to vertical deflection, suitably having a maximum 0.05 inch deflection. However, other embodiments employ a backbone portion of the skate that is more springy in the vertical direction, providing a skate with vertical flexing via the backbone, and lateral flexing via the beam.

The preferred embodiment of the present invention comprises an in-line skate that allows the wheels to conform to an arc when turning to emulate the turn radius, wherein the skate may include one or more of the following elements: a backbone frame for attaching a skate boot to the beam; a single attachment bracket for attaching the backbone frame to the beam and to allow for the flexing of the beam about a single attachment area, a flexible beam for attaching the wheels and for allowing changes in wheel alignment by flexing; and, wheels for movement.

A corresponding operational effect can be accomplished through several different embodiments that alter such elements as: the number or centerline of the wheels; length, thickness, location or number of beams; bracket location and configuration; or, backbone frame design. The beam can also be built up from composite layup beams, in a manner corresponding to ski manufacturing techniques, to provide an optimum weight and flexibility to the beam. An alternate embodiment also includes pivoting spring loaded assemblies in a manner to align the wheels to the radius of the turn.

Also, while the bracket 16 is illustrated as a separate piece attached to the backbone in the embodiments illustrated herein, in a still further embodiment of the skate, the backbone and bracket are suitably formed as single piece, for example, by casting or molding, simplifying assembly concerns.

Further, while the preferred attachment position is centrally of the boot, other configurations are possible, attaching the beam more forwardly or rearwardly of the center of the boot, for different performance characteristics. Also, the attachment position of the bracket 16 can be moved medially or laterally along the width of the boot to alter the characteristics of the turning.

Figure 8:
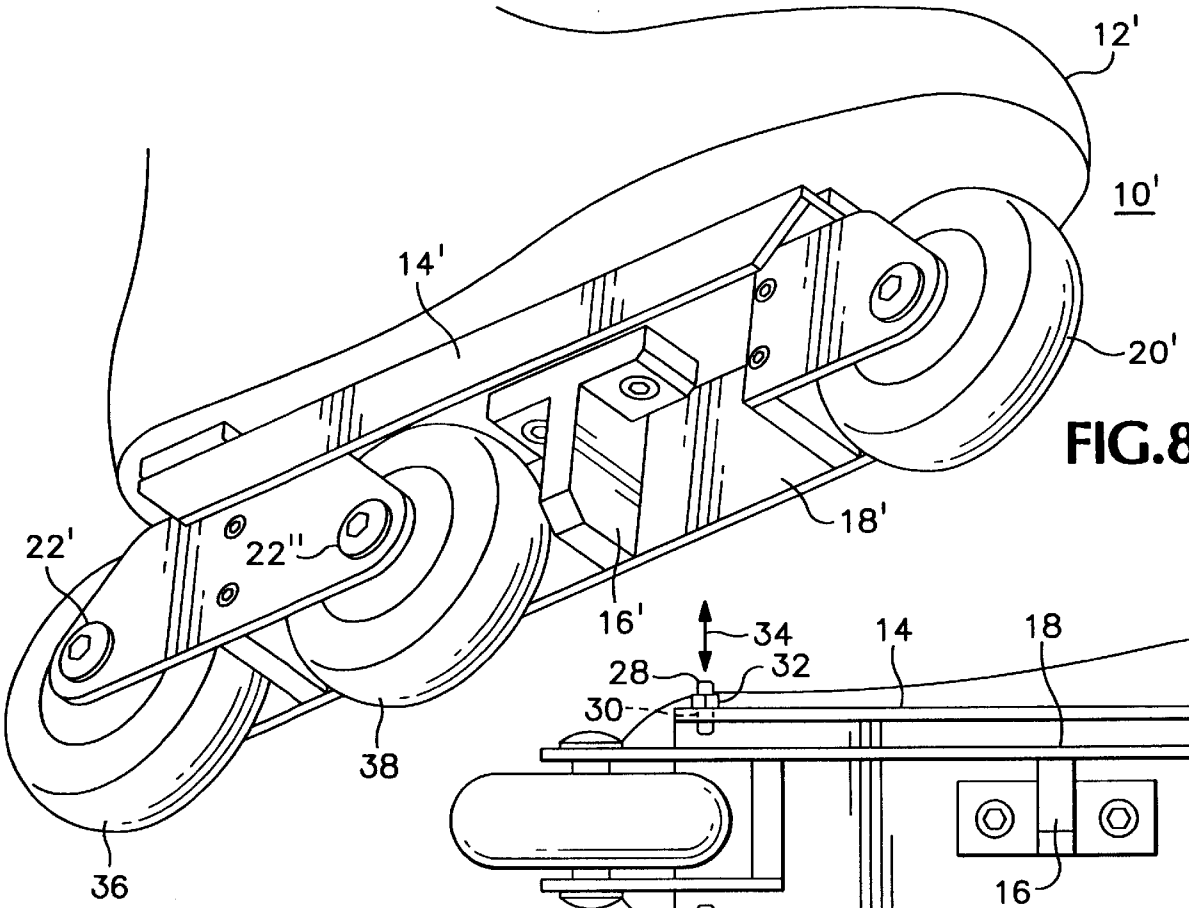
FIG. 8 is a lower side perspective view of another alternative skate with plural rear wheels.

While the above embodiments employ a single front wheel and a single rear wheel, in another embodiment, illustrated in FIG. 8, a lower side perspective view of another alternative skate with plural rear wheels, skate 10' comprises a skate boot 12' mounted on a rigid backbone frame 14'. In a manner corresponding to the single front/rear wheel boot, approximately centrally of the boot, mounted to the frame is bracket 16' providing the single position attachment of elongate beam 18'. Front wheel 20' comprises a single wheel, while rear wheels 36 and 38 are mounted in line, parallel with each other and with the front wheel, wheel 38 ahead wheel 36 along the longitudinal axis of the boot, via rearmost axle 22' and next rearmost axle 22'. As in the single front/rear wheel embodiment, the rear wheels are mounted to the beam 18' and the beam is mounted to the skate body, rather than having the wheels directly mounted to the skate body as in the prior art. Two rear wheels and one front wheel are employed in the preferred configuration of this embodiment, but still further embodiments employ multiple front wheels or multiple rear wheels.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A skate comprising:

a boot for securing a skater's foot therein, the boot having a sole;

a backbone frame fixedly attached to a bottom of the sole of the boot;

a single attachment bracket fixedly mounted to a central portion of the backbone frame and depending therefrom;

an elongated flexible beam having a front end portion, a rear end portion, and a central portion, the central portion being attached to said attachment bracket by a fixed connection with the flexible beam being oriented along a longitudinal axis of the skate boot, at least one wheel rotatably supported by a forward end of the flexible beam; and at least one wheel rotatably supported by a rearward end of the flexible beam;

wherein the flexible beam is configured for preventing bending in a vertical direction relative to the backbone and while permitting the front and rear portions of the flexible beam to bend about a vertical pivot axis formed by the fixed connection in directions extending laterally with respect to said longitudinal axis in response to lateral forces imposed thereupon during turning of the skate.

2. A skate according to claim 1 wherein said at least one wheel rotatably supported by a rearward end of the flexible beam comprises at least two wheels.

3. A skate according to claim 1, further comprising at least one flex stop for defining an extent of flexing by said elongated flexible beam in response to turning forces.

4. A skate according to claim 1 wherein said elongated flexible beam is substantially coextensive with said skate boot.

5. A skate according to claim 1 wherein said elongated flexible beam is of greater length than said skate boot.

6. A skate according to claim 1 wherein said front and rear portions of the flexible beam are adapted to bend in a medial direction.

7. A skate according to claim 1 wherein said front and rear portions of the flexible beam are adapted to bend in a lateral direction .

* * * * *